US010428514B2

(12) United States Patent
Chin

(10) Patent No.: US 10,428,514 B2
(45) Date of Patent: Oct. 1, 2019

(54) STEAM VENT SYSTEM

(71) Applicant: Consolidated Edison Company of New York, Inc., New York, NY (US)

(72) Inventor: Toykin Chin, White Plains, NY (US)

(73) Assignee: CONSOLIDATED EDISON COMPANY OF NEW YORK, INC., New York, NY (US)

( * ) Notice: Subject to any disclaimer, the term of this patent is extended or adjusted under 35 U.S.C. 154(b) by 0 days.

(21) Appl. No.: 15/596,520

(22) Filed: May 16, 2017

(65) Prior Publication Data

US 2018/0334791 A1 Nov. 22, 2018

(51) Int. Cl.

| | |
|---|---|
| ***E03F 5/08*** | (2006.01) |
| ***F23L 17/00*** | (2006.01) |
| *F24F 11/00* | (2018.01) |

(52) U.S. Cl.

CPC ..... *E03F 5/08* (2013.01); *F23L 17/00* (2013.01); *F24F 2011/0002* (2013.01); *F24F 2221/12* (2013.01)

(58) Field of Classification Search

CPC ..... E02D 29/14; E05Y 2900/612

USPC ..... 454/1, 47–48; 138/104, 114

See application file for complete search history.

(56) References Cited

U.S. PATENT DOCUMENTS

| | | | | |
|---|---|---|---|---|
| 4,166,477 | A * | 9/1979 | Duthion | F15D 1/08 126/307 R |
| 5,791,985 | A * | 8/1998 | Schiedegger | F24F 7/02 454/339 |
| 7,640,884 | B2 * | 1/2010 | Tamez, Jr. | A62B 3/00 116/205 |
| 7,715,193 | B1 * | 5/2010 | Ye | H05K 7/20145 312/236 |
| 2013/0087238 | A1 * | 4/2013 | Mercier | F16L 3/26 138/118.1 |
| 2016/0356521 | A1 | 12/2016 | Bertini et al. | |
| 2016/0356522 | A1 | 12/2016 | Bertini et al. | |

* cited by examiner

*Primary Examiner* — Steven B McAllister
*Assistant Examiner* — Ko-Wei Lin
(74) *Attorney, Agent, or Firm* — Cantor Colburn LLP

(57) ABSTRACT

A movable steam vent system is provided. The system includes a base and at least one pipe member. The base includes a tapered outer surface defined by an outer wall, a frustoconical inner surface defined by an inner wall, a plurality of ribs extending from the inner surface, the inner wall and the outer wall defining a space therebetween, the base further having an opening in an upper surface, the opening having a slot therein, the opening being in fluid communication with a hollow interior defined by the inner wall, the inner wall having an end that is sized to cover the subsurface space opening. The at least one pipe member is removably coupled to the base, the at least one pipe member having a having an outer wall, an inner wall, the inner wall defining a hollow interior that is in fluid communication with the base hollow interior.

17 Claims, 7 Drawing Sheets

STEAM VENT SYSTEM

BACKGROUND

The subject matter disclosed herein relates to a steam vent system, and in particular to a venting system that captures and removes steam vapor from district heating systems.

In large metropolitan areas, it is not uncommon for a central boiler system to be used to generate heat for multiple facilities in the surrounding area. This heating system is sometimes referred to as district heating or teleheating. The steam is transported via insulated pipes to subscribing buildings, which purchase the steam from the steam utility. Similar to an electric meter, a steam meter measures the amount of steam used by a particular building and the building owner is charged on a periodic basis.

The insulated pipes are typically routed underground, such as subsurface structures under or adjacent to city streets. In some cases subsurface structures are provided to allow service personnel access to the insulated pipes and components. These subsurface structures are commonly referred to as "manholes." These manholes are accessed via openings, typically include a cover, such as a cylindrical disk for example, which encloses the subsurface structure. In the event of a leakage of steam from the insulated pipe and or a component, such as at a joint for example, the steam will typically flow through the manhole and exit through or around the manhole cover. Steam may also be generated by underground water infiltration that impinges or otherwise comes into contact with the pipes.

When this occurs, service personnel typically use steam vents to redirect the steam away from pedestrians and traffic until the steam vapor condition can be mitigated. These steam vents are currently made from high-density-polyethylene (HDPE) where the sections of the vent are fused together. These vents are heavy and cumbersome to handle. As a result, they are subjected to repeated impact loading when dropped due to the weight of the assembly. This causes premature joint failures, resulting in costly replacement of the steam vents. Previous version of steam vent designs used fiberglass layered material that was labor intensive and costly to produce and are vendor no longer exists.

Accordingly, while existing steam vent systems are suitable for their intended purposes the need for improvement remains, particularly in providing a durable, joint free light weight and cost effective steam vent system.

BRIEF DESCRIPTION

According to one aspect of the disclosure, a movable steam vent system for an enclosed subsurface space having an opening is provided. The system a base portion and at least one pipe member. The base portion includes a tapered outer surface defined by an outer wall, a frustoconical inner surface defined by an inner wall, a plurality of ribs extending from the inner surface, the inner wall and the outer wall defining a space therebetween, the base portion further having an opening in an upper surface, the opening having a slot therein, the opening being in fluid communication with a first hollow interior defined by the inner wall, the inner wall having an end that is sized to cover the subsurface space opening. The at least one pipe member is removably coupled to the base portion, the at least one pipe member having a having an outer wall, an inner wall, the inner wall defining a second hollow interior that is in fluid communication with the first hollow interior.

According to another aspect of the disclosure, another system for venting steam from a manhole is provided. The system includes a base member and a first pipe member. The base member includes a flange on a first end, a curved outer wall, a conical inner surface defining a first interior portion, a frustoconical first opening in a second end opposite the first end, the first opening being defined by a wall having at least one slot and a bottom surface, and a hole extending between the first interior portion and the bottom surface, the flange being sized to cover an outer diameter of the manhole. The first pipe member being removably coupled to the base member, the first pipe member having a wall and a second hollow interior portion defined by an inner surface of the wall, the first pipe member having a first projection extending from a first end, the frustoconical projection being sized to fit within the first opening, the projection having a first tab member sized to fit within the at least one slot when the first pipe member is coupled to the base member, the second interior portion being fluidly coupled to the first interior portion when the first pipe member is coupled to the base member.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

Figure 1:
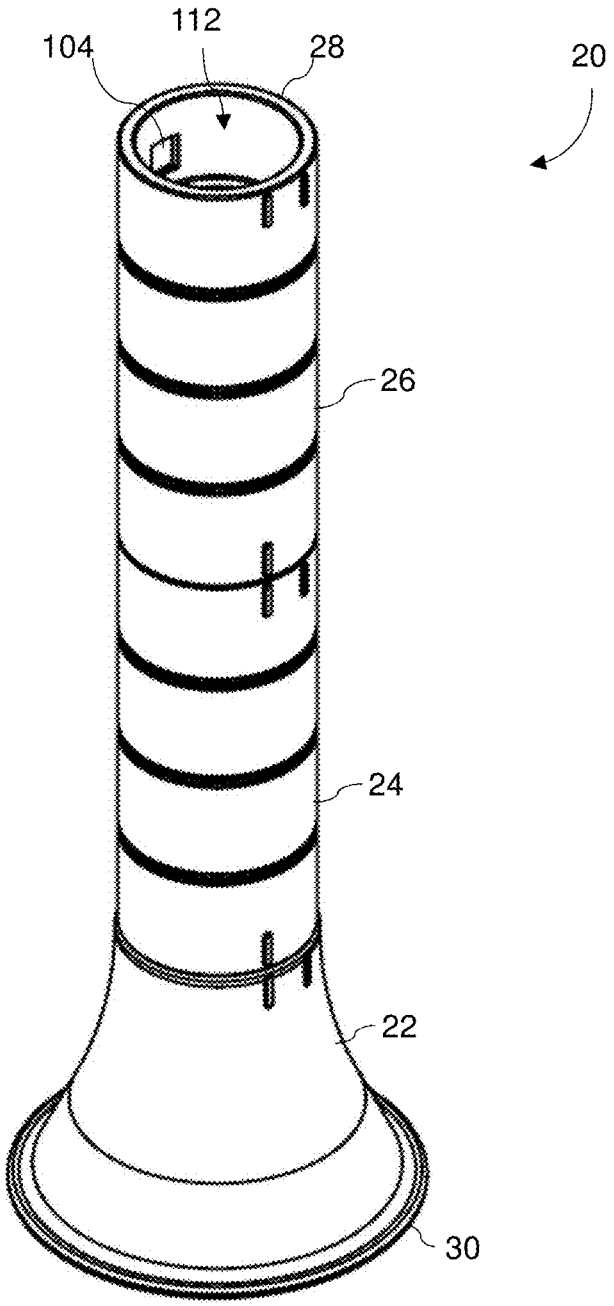
FIG. 1 is a perspective view of a steam vent system in accordance with an embodiment.
Figure 2:
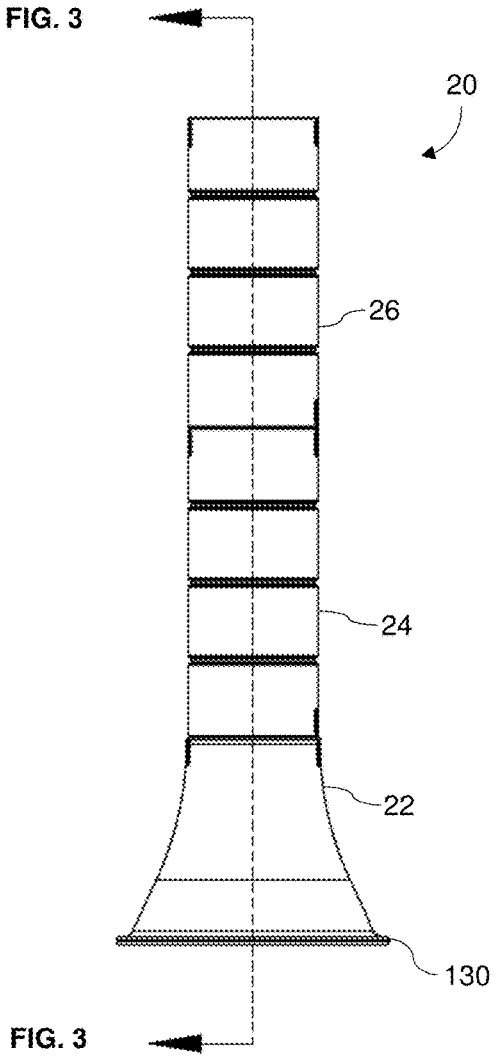
FIG. 2 is a side view of the steam vent system of FIG. 1.
Figure 3:
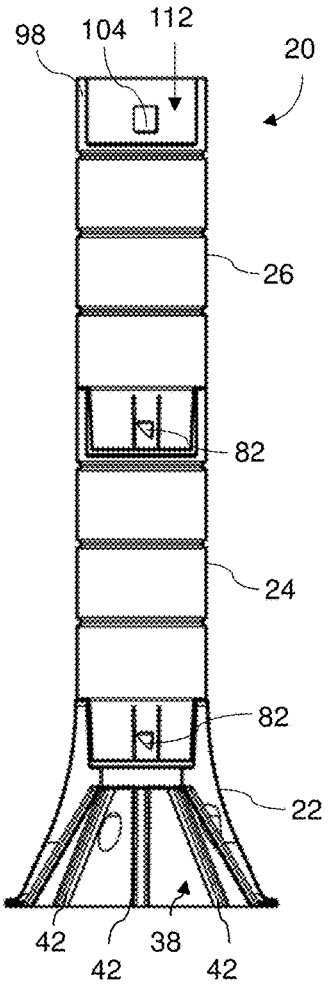
FIG. 3 is a sectional view of the steam vent system of FIG. 2.
Figure 4:
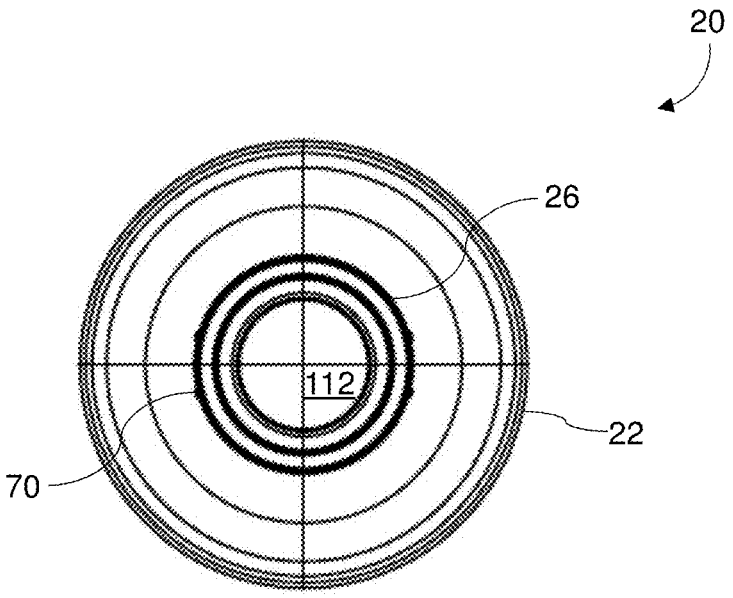
FIG. 4 is a top view of the steam vent system of FIG. 1.
Figure 5:
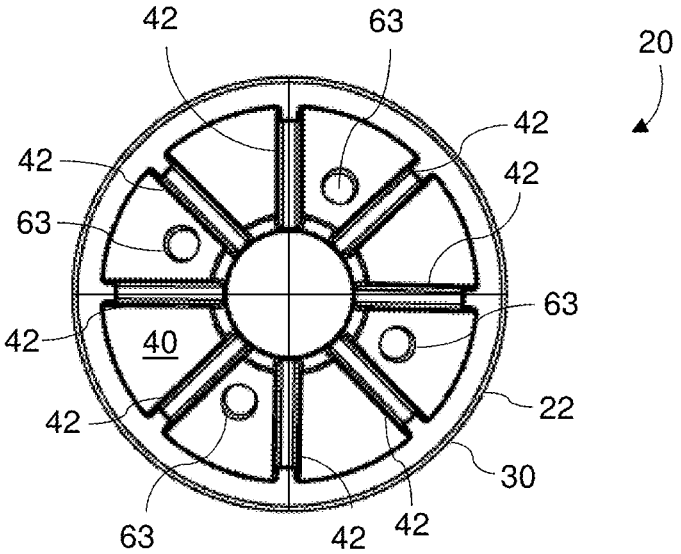
FIG. 5 is a bottom view of the steam vent system of FIG. 1.

The detailed description explains embodiments of the disclosure, together with advantages and features, by way of example with reference to the drawings.

DETAILED DESCRIPTION

Embodiments of the present invention provide for a steam vent system that is easy for service personnel to assemble and disassemble at an installation site. Further embodiments of the present invention provide for a steam system that is light weight and economical to produce.

Referring now to FIGS. 1-5, an embodiment is shown of a steam vent system 20. In an embodiment, the system 20 is comprised of a base member 22, a first pipe member 24 and a second pipe member 26. The members 22, 24, 26 are removably coupled to each other allowing the system 20 to be assembled and disassembled for transportation and storage. As will be discussed in more detail herein, in an embodiment, the pipe members 24, 26 each of a tab that engages a slot in the adjoining member. When the adjoining members are rotated relative to each other, the tab may be moved into and out of the slot to allow the members 22, 24, 26 to be coupled and decoupled from each other. In an embodiment, when the members 22, 24, 26 are assembled, an end 28 of the second pipe member is disposed at least 10 feet above the ground.

Figure 6:
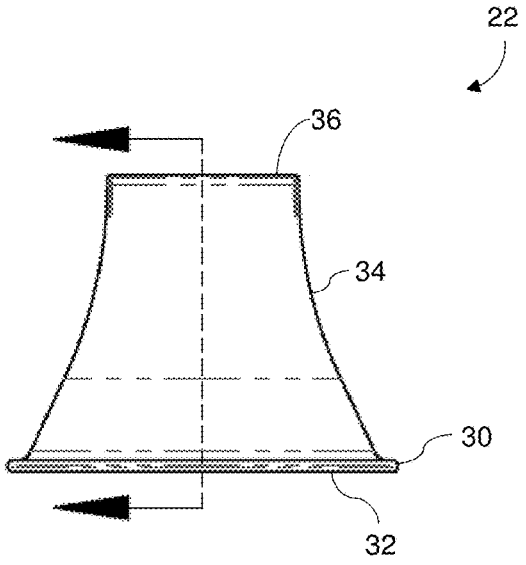
FIG. 6 is a base member for use with the steam vent system of FIG. 1 in accordance with an embodiment.
Figure 7:
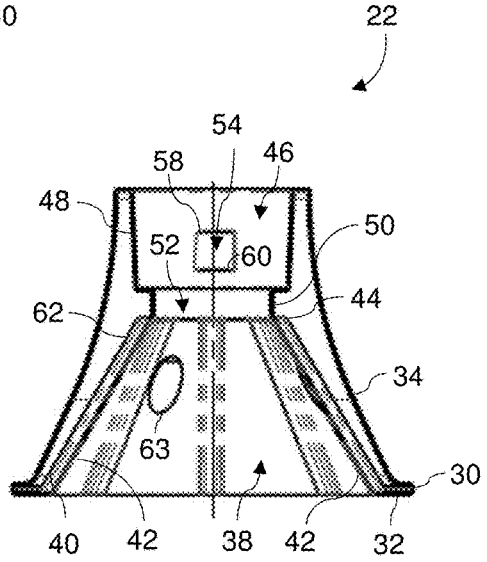
FIG. 7 is a sectional view of the base member of FIG. 6.
Figure 8:
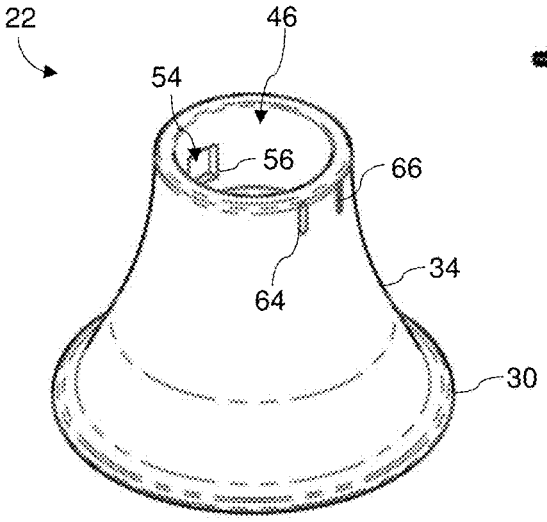
FIG. 8 is a perspective view of the base member of FIG. 6.

Referring now to FIGS. 6-8, an embodiment is shown of the base member 22. The base member 22 includes a flange 30 on an end 32. An outer wall 34 extends from the flange 30 to a second end 36. In an embodiment, the outer wall 34 has a substantially uniform thickness and tapers from a first diameter adjacent the flange 30 to a second diameter adjacent the end 36. In an embodiment, the outer wall has a concave shape. In an embodiment, the wall thickness of the outer wall 34 is about 0.275 inches.

The end 32 includes an opening into a hollow interior portion 38 that is defined by an interior wall 40. In an embodiment, the interior wall 40 has a substantially uniform thickness. In an embodiment, the thickness of wall 34 is 0.275 inches. In an embodiment, a plurality of ribs 42 extend from the inner wall 40 and are arrange equidistant about the periphery of the hollow interior portion 38. In an embodiment a plurality of openings 63 may extend through the interior wall 40. An end wall 44 is arranged opposite the opening in end 32 to define the end of the hollow interior portion 38. In an embodiment, the inner wall 40 and end wall 44 cooperate to define a frustoconical shaped interior portion 38.

An opening 46 extends from the second end 36. The opening 46 is defined by a wall 48. In an embodiment the wall 48 has a substantially uniform thickness. In an embodiment, the thickness of wall 48 is 0.275 inches. The bottom of the opening 46 is defined by a wall 50. In an embodiment, an opening 52 extends between the wall 44 and the wall 50 to allow the opening 46 to be fluidly coupled to the hollow interior portion 38. In the illustrated embodiment, the walls 48, 50 cooperate to define a frustoconical shape to the opening 46.

In an embodiment, a slot 54 is formed in the wall 48. The slot 54 is defined by three side walls 56 and an edge 58. The edge 58 being coplanar with the wall 48. In an embodiment, the rear wall 60 is curved. As will be discussed in more detail herein, the curved rear wall 60 allows the tab on the pipe member 24 to enter into and be removed from the slot 54 when the pipe member 24 is rotated relative to the base member 22. In an embodiment, the base member 22 has two slots spaced 180 degrees apart. In one embodiment, the base member 22 may have indicator elements 64, 66 formed on the outer wall 34. As will be discussed in more detail herein, the indicators 64, 66 are aligned with the outer edges of the slot 54. This provides advantages in allowing the service personnel to visually see when the tab is fully engaged in the slot 54. The indicator elements 64, 66 may be formed in the outer wall 34 as a projection or a slot, or may be a printed or painted thereon.

The walls 34, 40, 48 define a hollow space 62. It should be appreciated that the dual wall arrangement provides for a strong and rigid structure while maintaining a light weight that allows the base member 22 to be handled by a single person. In an embodiment, one or more openings 63 extend through the wall 40.

Figure 9:
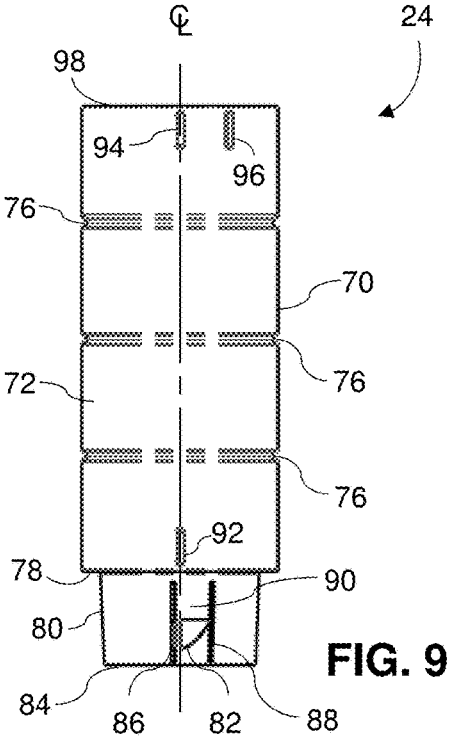
FIG. 9 is a first side view of a pipe member for use with the steam vent system of FIG. 1 in accordance with an embodiment.
Figure 10:
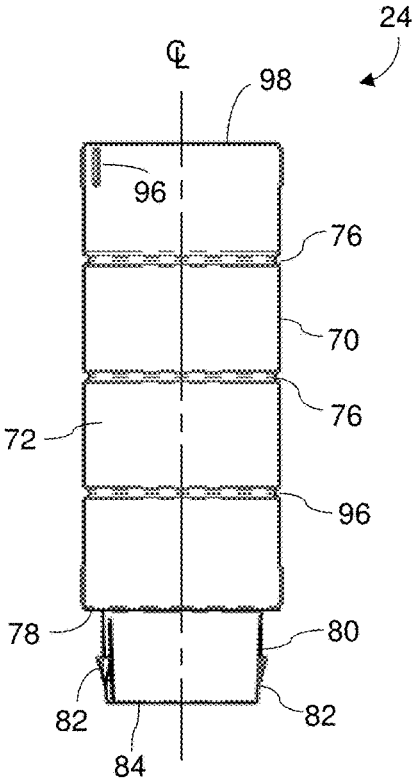
FIG. 10 is a second side view of the pipe member of FIG. 9.
Figure 11:
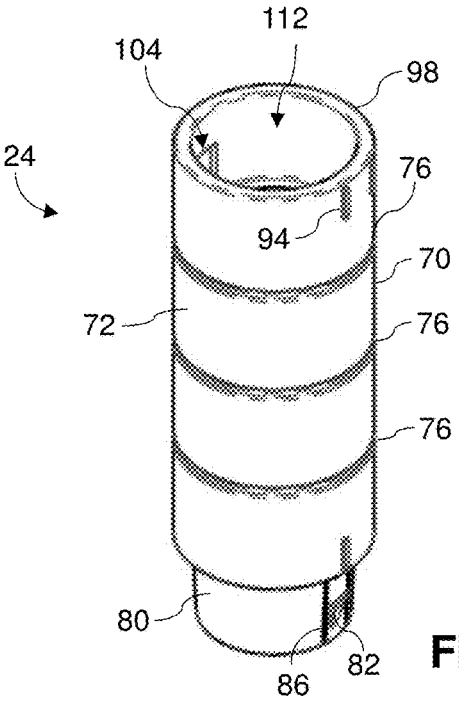
FIG. 11 is a perspective view of the pipe member of FIG. 9.
Figure 12:
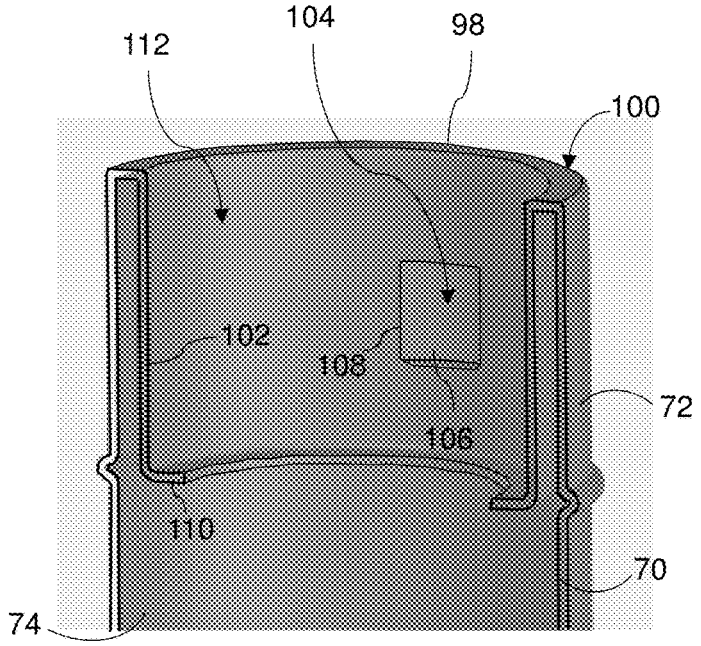
FIG. 12 is an enlarged partial section view of the pipe member of FIG. 9.

Referring now to FIGS. 9-11, an embodiment is shown of the first pipe member 24. In the exemplary embodiment, the second pipe member 26 is identical to the first pipe member 24. The pipe member 24 has a single wall 70 having an outer surface 72 and an inner surface 74 (FIG. 12). In an embodiment, the pipe member 24 may have one or more circumferential slots 76 arranged along its length. A projection 80 extends from a first end 78. In the exemplary embodiment, this projection 80 may be integrally formed with the wall 70. In other embodiments, the projection 80 may be formed separately and coupled to the wall 70. The projection 80 has a diameter sized to fit into the opening 46. In an embodiment, the projection 80 has a frustoconical shape.

A tab member 82 is formed on the outer surface of projection 80. In the exemplary embodiment, the tab 82 has two sidewalls and a semi-spherical outer surface. The outer edge of the semi-spherical surface is curved. The tab 82 is positioned a distance from the bottom lip 84 to position the tab 82 in the slot 54 when the pipe member 24 is coupled to the base member 22. In one embodiment, the projection 80 includes a pair of channels 86, 88 that extend parallel to the centerline of the pipe member 24. The channels 86, 88 extend through the wall of the projection 80. This allows the section 90 of the projection between the channels 86, 88 to deflect when the projection 80 is inserted into the opening 46. The elasticity of the material then moves the section 90 back towards its original position when the tab 82 enters the slot 54. Similarly, when the service personnel rotate the pipe member 24 relative to the base member 22 to disassemble the system 20, the semi-spherical surface of the tab slides along the curved surface 60 of the slot 54 causing the section 90 to deflect inwards. Once the tab 82 is past the edge 58, the pipe member 24 may be removed from the base member 22. In an embodiment, the pipe member 24 includes two sets of tab 82, channels 86, 88 and section 90 spaced 180 degrees apart.

In the exemplary embodiment, the pipe member 24 includes an indicator element 92 adjacent the end 78 that is aligned with the sidewall of tab 82. In one embodiment, the sidewall and the indicator element 92 are aligned with the centerline of the pipe member 24. In an embodiment, the pipe member 24 further includes two additional indicator elements 94, 96 adjacent an opposite end 98. The indicator elements 92, 94, 96 may be formed in the wall 70 as a projection or a slot, or may be a printed or painted thereon.

As shown in FIG. 12, the wall 70 forms a u-shaped bend 100 at the end 98 and extends back towards the end 78 to form an inner wall portion 102. The inner wall portion 102 is sized to receive the projection 80 from second pipe member 26. The inner wall portion 102 further includes a slot 104. In an embodiment, the slot 104 is substantially identical to slot 54 of base member 22. The slot 104 includes three side walls and a curved surface 106 having an edge 108 that is coplanar with the inner surface of inner wall portion 102. The slot 104 is sized to receive the tab 82 of second pipe member 26. In an embodiment, the inner wall portion 102 includes a lip 110 on an end opposite the u-shaped bend 100.

Figure 13:
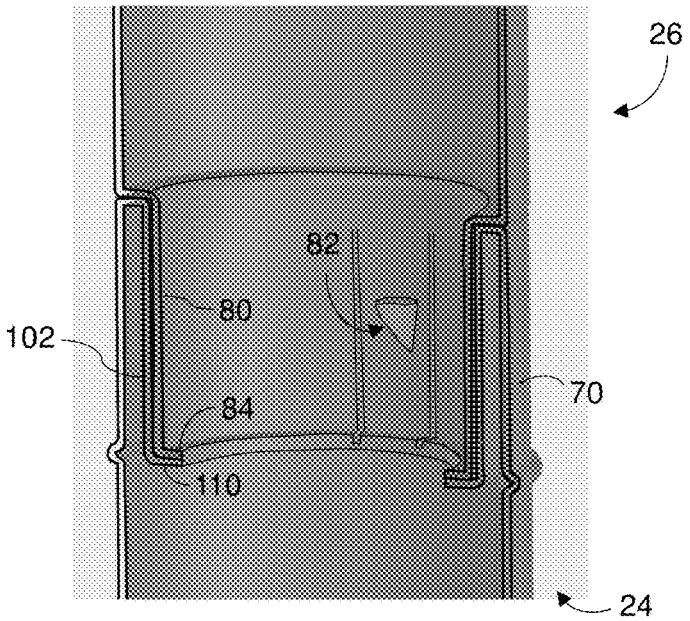
FIG. 13 is an enlarged partial sectional view of a first pipe member coupled to a second pipe member in accordance with an embodiment.

As shown in FIG. 13, in operation, the service personnel insert the projection 80 of second pipe member 26 into the opening 112 until the lip 84 contacts the lip 110. It should be appreciated that as the second pipe member 26 is inserted into the opening 112, the section 90 of second pipe member 26 deflects to allow the tab 82 to contact the inner wall portion 102 of the first pipe member. The second pipe member 26 is then rotated relative to the first pipe member 24 causing tab 82 of the second pipe member 26 to enter the slot 104 of the first pipe member 24.

In the exemplary embodiment, the base member 22, the first pipe member 24, and the second pipe member 26 are formed from a cross-linked polyethylene material and are formed by rotational molding.

Figure 14:
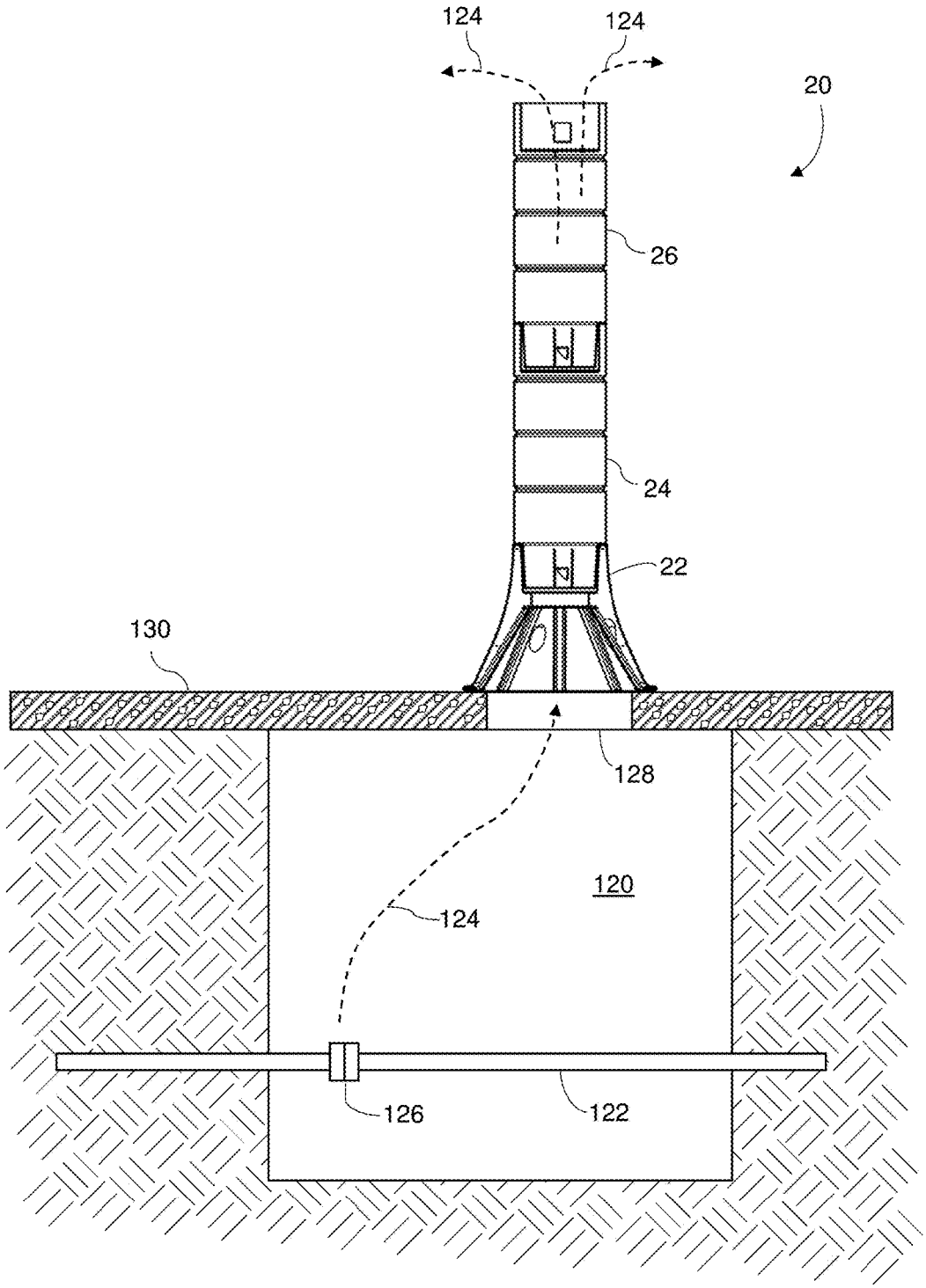
FIG. 14 is a sectional view of the steam vent system installed over a subsurface chamber.

Referring now to FIG. 14, an embodiment is shown of the installation of the system 20 over a subsurface chamber 120 to vent steam until the service personnel can address the leakage. In an embodiment, the chamber 120 may have a steam conduit 122 extending therethrough. The steam conduit 122 is part of a distribution system that transfers high pressure steam from a generation location to a consumer facility. It should be appreciated that the steam 124 may form within the chamber 120. The source of this steam 124 may be due to a variety of causes, such as condensation forming on the conduit 122 or a leak from the conduit 122, such as at a joint 126 between two adjacent conduits 122.

It is undesirable to allow the steam 124 to simply vent from the chamber 122 through the manhole 128 at ground level. Therefore, service personnel may be dispatched to the location of the steam to install a system 20. The system 20 diverts the steam 124 away from the ground 130 to a suitable height to allow the steam to dissipate. Upon arriving at the location, service personnel will place the base member 22 with the flange 30 on the ground. The projection 80 of the first pipe member 24 is inserted into the opening 46 with indicator element 88 aligned with the indicator 64. The first pipe member 24 is then rotated relative to the base member 22 to move indicator elements 86, 88 to align with the indicator elements 64, 66 respectively. At this point, the first pipe member 24 is coupled to the base member 22. If the first pipe member 24 is moved laterally relative to the base member 22, the sidewall of the tab 82 will contact the side wall of the slot 54 preventing the separation of the first pipe member 24 from the base member 22.

The projection 80 of the second pipe member 26 is then inserted into the opening 112 of first pipe member 24. The second pipe member 26 is rotated relative to the first pipe member 24 to engage the tab 82 of the second pipe member 26 with the slot 104 of the first pipe member 24 as discussed herein. It should be appreciated that the assembly of the system 20 provides a contiguous fluid path from the flange 30 on one end to the end 98 of second pipe member 26. With the second pipe member 24 installed, the system 20 may be positioned with the flange 30 disposed over/around the manhole 128. This allows the steam 124 to flow through the hollow interior 38 of the base member 22 and through the interior of the first pipe member 24 and the second pipe member 26 to the end 98 of second pipe member 26 where it is released to the environment. In the exemplary embodiment, the system 20 extends about 10 feet above the ground 130. This provides a desired level of dissipation of the steam 124.

It should be appreciated that the hollow wall configuration of the base member 22 and the substantially single wall configuration of the pipe members 24, 26 results in a light weight but structurally robust body that may be quickly and easily installed by service personnel. It should further be appreciated that the capability of quickly and easily assembling and disassembling the system 20 reduces wear and tear on the system 20 relative to the prior art unitary body steam vents.

As used herein, the term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A movable steam vent system for an enclosed subsurface space having an opening, the system comprising:

a base portion having a tapered outer surface defined by an outer wall, a frustoconical inner surface defined by an inner wall, a plurality of ribs extending from the inner surface, the inner wall and the outer wall defining a space therebetween, the base portion further having an opening in an upper surface, the opening being defined by a wall having a slot therein, the opening being in fluid communication with a first hollow interior defined by the inner wall, the inner wall having an end that is sized to cover the subsurface space opening; and at least one pipe member removably coupled by a rotational movement to the base portion, the at least one pipe member having a wall with an outer surface, and an inner surface, the pipe member inner surface defining a second hollow interior that is in fluid communication with the first hollow interior;

wherein the at least one pipe member includes a projection that extends from a first end, the projection being sized to fit within the base portion opening;

wherein the projection of the at least one pipe member includes a first tab, the first tab being positioned in the slot of the base portion when the at least one pipe member is coupled to the base portion;

wherein the first tab includes a semi-spherical outer surface with a curved outer edge and two adjoining sides.

2. The system of claim 1, wherein the at least one pipe member includes a first pipe member and a second pipe member, the first pipe member being removably coupled to the base portion opening and the second pipe member being removably coupled to a second end of the first pipe portion opposite the base portion.

3. The system of claim 1, wherein the slot of the base portion includes an arcuate surface with an end being coplanar with the base portion inner wall.

4. The system of claim 1, wherein the projection includes a first channel and a second channel disposed on opposite sides of the first tab member.

5. The system of claim 4, wherein first pipe member includes a first indicator element in the outer surface, the first indicator element being aligned with a centerline of the first pipe member.

6. The system of claim 5, wherein the base portion includes a second indicator element in the outer surface adjacent the base portion opening, the second indicator element being aligned with and adjacent to the second slot when the first pipe portion is coupled to the base portion.

7. A system for venting steam from a manhole, the system comprising:

a base member including a flange on a first end, a curved outer wall, a conical inner surface defining a first interior portion, a frustoconical first opening in a second end opposite the first end, the first opening being defined by a wall having at least one slot and a bottom surface, and a hole extending between the first interior portion and the bottom surface, the flange being sized to cover an outer diameter of the manhole, wherein the curved outer wall and conical inner surface defining a hollow space therebetween; and a first pipe member removably coupled by a rotational movement to the base member, the first pipe member having a wall and a second hollow interior portion defined by an inner surface of the wall, the first pipe member having a frustoconical first projection extending from a first end, the frustoconical first projection being sized to fit within the first opening, the projection having a first tab member sized to fit within the at least one slot when the first pipe member is coupled to the base member, the second interior portion being fluidly coupled to the first interior portion when the first pipe member is coupled to the base member;

wherein the first tab member includes a semi-spherical outer surface with a curved outer edge and two adjoining sides.

8. The system of claim 7, wherein the first pipe member includes a second opening in a second end opposite the first end, the second opening having a wall extending toward the first end to define a third hollow interior portion, the second opening wall having a lip on an end.

9. The system of claim 8, further comprising a second pipe member removably coupled to the first pipe member, the second pipe member includes a wall with an inner surface that defines a third interior portion, the second pipe member having a second projection extending from a first end, the second projection being sized to fit within the second opening.

10. The system of claim 9, wherein:

the first pipe member includes a second slot in the second opening wall; and the second pipe member includes a second tab extending from the second projection, the second tab being disposed in the second slot when the second pipe member is coupled to the first pipe member.

11. The system of claim 7, wherein the base member further includes a plurality of ribs extending along the conical inner surface, the plurality of ribs being equally spaced about the periphery of the conical inner surface.

12. The system of claim 7, wherein the first pipe member includes:

a first channel extending from the first end, the first channel being offset from a first side of the first tab; and a second channel extending from the first end and arranged opposite the first tab from the first channel.

13. The system of claim 12 wherein the first pipe member includes a first indicator element on an outer surface of the wall, the first indicator element being aligned with the first channel.

14. The system of claim 13, wherein the first pipe member includes a second indicator element on the outer surface of the wall, the second indicator being aligned with a centerline of the first pipe.

15. The system of claim 14, wherein the first indicator and the second indicator are projections extending radially from the outer surface.

16. The system of claim 7, wherein the base member is formed by rotational molding.

17. The system of claim 12, wherein the first pipe member is formed by rotational molding.

* * * * *